United States Patent [19]

Alexander

[11] Patent Number: 4,538,846

[45] Date of Patent: Sep. 3, 1985

[54] CARPET STRETCHER ASSEMBLY

[76] Inventor: Jerry M. Alexander, 140 Illinois Blvd., Hoffman Estates, Ill. 60195

[21] Appl. No.: 132,802

[22] Filed: Mar. 24, 1980

[51] Int. Cl.[3] ..... A47G 47/04

[52] U.S. Cl. ..... 294/8.6; 254/209; 254/212

[58] Field of Search ..... 294/8.6; 254/57, 58, 254/59, 60, 61, 62, 63, 200–212

[56] References Cited

U.S. PATENT DOCUMENTS

| | | | |
|---|---|---|---|
| 2,606,743 | 8/1952 | Owens | 294/8.6 |
| 3,441,252 | 4/1969 | Koppelmans | 294/8.6 |
| 3,706,440 | 12/1972 | Ross | 254/212 |
| 3,752,440 | 8/1973 | Ream | 254/209 |

OTHER PUBLICATIONS

Senior Power Stretcher 10–222 & Junior Power Stretcher 10–238, both having flat pivotal tail blocks.

An extension tubing & tail block assemble for Roberts Power Stretcher 10–222 having flat surface tail blocks 10–253–14 & 10–232–17 on a sheet from a Roberts Manufacturing Company catalogue.

No. 400–CS Jr. Power Carpet Stretcher from a page of a trade catalogue.

A kneekicker bumper 10–412–09.

Roberts Power Stretcher tail block swivel tubing with adjustment buttons 10–232–15 connected to a cushioned tail block 10–232–16 & a tail block swivel button assembly 10–232–18.

*Primary Examiner*—James B. Marbert

*Attorney, Agent, or Firm*—Dillis V. Allen

[57] ABSTRACT

A plurality or kit of brace assemblies for a carpet stretcher of the type having a carpet gripping head supported by a plurality of elongated telescoping tubular sections that are adjustable to vary the effective length of the head from a fixed support. Three interchangeable brace assemblies are provided, each of which may be substituted by the installer for the standard wall engaging foot on the end telescopic section. Each of the braces is adapted to fit around a fixed discrete vertical support commonly found in areas where carpets are installed such as support posts. All the brace assemblies include a "U" shaped retainer and a tubular base. The largest of these brace assemblies includes a U-shaped arcuate retainer that is adapted to fit around and grasp one of the cylindrical support posts in the carpet installation area. This retainer has a non-pivotal connection to a base that snaps in the telescopic tubular sections of the stretcher. A second brace assembly is provided in the kit having a smaller U-shaped retainer with a rectangularly shaped interior surface adapted to grasp a rectangular support in the carpet area. This brace has a vertical pivotal connection between its retainer and base. A third brace assembly is provided in the kit having an even smaller U-shaped retainer with a vertical pivotal interconnection to its base.

6 Claims, 5 Drawing Figures

CARPET STRETCHER ASSEMBLY

BACKGROUND OF THE INVENTION

Carpet stretching devices are universally used by commercial carpet installers to assure a wrinkle and fold free contact between the carpet, its cushioning pad and the underlying flooring. One such carpet stretching device includes a rectangular head assembly having a plurality of rows of parallel, forwardly angled pins that extend through the carpet matting and grip against the jute backing. One end of a plurality of telescoping sections is pivotally connected to this head with a pivotal L-shaped foot on the other end of the telescoping sections that reacts against a flat surface such as one wall in the area being carpeted. A hand operated toggle linkage is provided between the telescoping sections adjacent the head to provide the necessary leverage for moving the head horizontally forwardly and driving the carpet away from the wall against which the foot reacts. As the carpet is stretched away from the reacting wall, the installer conventionally adds additional telescoping sections as necessary to stretch the carpet entirely across the carpeting area.

It is not uncommon for the installer to add enough rod sections so that the head projects twenty or thirty feet away from the reacting wall. The problem presented by this procedure, apart from requiring a great many telescopic rod sections, is that the telescopic rod sections begin to bend, snake and sway because of their undue length which reduces greatly the effectiveness of the stretching forces. In order to overcome this problem an installer might attempt to place the flat wall foot on the end of the telescopic sections against an abutment other than a wall, such as a door jam, but in such cases it frequently happens that the foot will slide off of the abutment disrupting the carpet laying operation, and in some cases because of the high reaction forces against the foot, causing injury to personnel in the carpet installing area.

It is a primary object of the present invention to ameliorate the problems noted above in the wall reaction type telescopic rod carpet stretching devices.

SUMMARY OF THE PRESENT INVENTION

In accordance with the present invention, a plurality or kit of brace assembly attachments is provided for a carpet stretcher of the telescopic rod and head type each of which fit around discrete vertical supports in the carpet installation area to reduce the required length of the telescopic rod sections to a minimum and improve the carpet installation procedure.

There are three brace assemblies provided according to the present invention each of which is interchangeable with the standard L-shaped reaction foot of a conventional carpet stretching assembly. The first of these brace assemblies includes a large U-shaped retainer portion having an arcuate interior grasping surface that fits around and holds the retainer assembly to a round vertical support post in the carpet area, such as the cylindrical cast iron support posts conventionally found in buildings for supporting the main ceiling beams. The arcuate interior grasping surface on this retainer permits the brace assembly to be positioned in any angular position, 360 degrees around the support post, and the stretching head thus has the same freedom of movement. The retainer is rigidly, non-pivotally connected to a base tube carrying spring detent pins that snap within holes in the end section of the telescoping tubes. Since these vertical ceiling support posts are frequently found at central positions within the carpet installation area, a fewer number of rod sections is required to complete the carpet installation than would be required if the wall reaction foot alone were employed reacting against one of the outer walls.

The second brace assembly in the kit also has a U-shaped retainer, but this attachment has a rectangularly shaped interior surface so that it non-rotatably fits around a rectangular support in the carpet installation area, such as a stair railing. This retainer is connected to a base tube by a vertical pivotal connection that permits the stretcher head to be pivoted with respect to the retainer to accommodate a variety of stretching locations for the stretcher head.

The third brace assembly also includes a U-shaped retainer but it has a smaller rectangular interior surface to fit around and grasp either a small rectangular support in non-rotatable fashion or a round support. The retainer is pivotally mounted about a base tube by a vertical pivotal interconnection that has stops to limit the pivotal movement so that when the retainer is positioned about and grasps a small or circular support that permits pivotal movement of the retainer with respect thereto, the stops prevent the retainer from rotating around the fixed support as the force of the stretcher head reacts against the retainer.

It is thus seen that the present invention consists of a set of U-shaped reaction braces for a telescopic rod carpet stretcher, each of which is adapted to fit around and hold the reacting end of the telescopic rod sections in a fixed position against vertical supports having different configurations.

DETAILED DESCRIPTION OF THE PREFERRED EMBODIMENT

Figure 1:
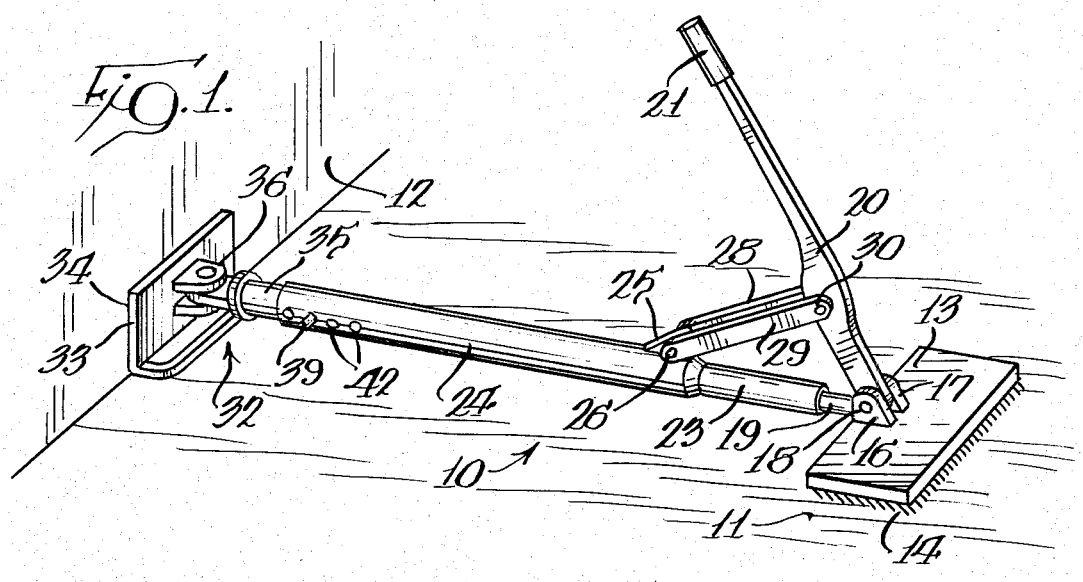
FIG. 1 is a perspective view of a conventional telescopic tube carpet stretcher having a standard L-shaped wall reaction foot.

Viewing the drawings and particularly FIG. 1, a conventional carpet stretcher 10 is illustrated that functions basically to stretch newly installed carpeting 11 by reacting against a wall 12 in the carpet installation area. Carpet stretcher 10 is seen to include a rectangular head member 13 having a plurality of rows of forwardly angled parallel pins 14 projecting from the underside thereof that are carried by a die cast plate that is not seen in the plane of the perspective of FIG. 1. This plate fits within a recess on the underside of the head member 13. Head 13 has a pair of spaced pivot bosses 16 and 17 having a pivot pin 18 extending therethrough that pivotally supports a head end tube 19, and an advancing arm 20, that has a hand grip portion 21 on the distal end thereof. Head end tube 19 is slidable in a reduced sleeve portion 23 of a main telescopic tube 24. Tube 24 has a pivot boss 25 near the forward end thereof that carries a pivot pin 26 fixed to toggle bars 28 and 29 to pivotally support the bars on tube 24. The opposite ends of bars 28 and 29 are pivotally connected to bar 20 by a pin 30 spaced from pivot pin 18.

A standard L-shaped reaction foot assembly 32 is carried by the distal end of the main rod 24 and includes an L-shaped foot member 33 having a flat wall engaging surface 34, a base tube 35 and a vertical pivot interconnection 36 between the foot 33 and the base tube 35. The base tube 35 may be adjustably positioned in the main tube 24 by detent pins 39 that fit in one of several diametral pair openings 42 adjacent the end of the main tube 24. It should be understood that openings 42 are defined in diametral pairs to accommodate pins 39 on the diametrally opposite sides of the base tube 35. Pivotal interconnection 36 permits the head 13 to be swung limited distances to either side of a line extending through pivot 36 perpendicular to wall 12 to provide limited lateral movement of the head 13.

In operation of the carpet stretcher 10, stretching is begun, after fixing carpet 11 along the base line of a wall 12 by conventional tackless carpet techniques, by engaging headpins 14 with the carpet and rotating the handbar 20 downwardly by hand grip 21. This causes the bar 20 reacting against the toggle links 28 and 29 to shift the head 13 rightwardly as viewed in FIG. 1, sliding head tube 19 outwardly several inches from main tube reduced section 23. After repeating this procedure along wall 12, an additional telescopic section, not illustrated in drawings, is inserted in the distal end of tube 24 and the tube base 35 reinserted in the distal end of the new rod section and the entire process is repeated extending the head 13 a further distance away from wall 12.

Figure 2:
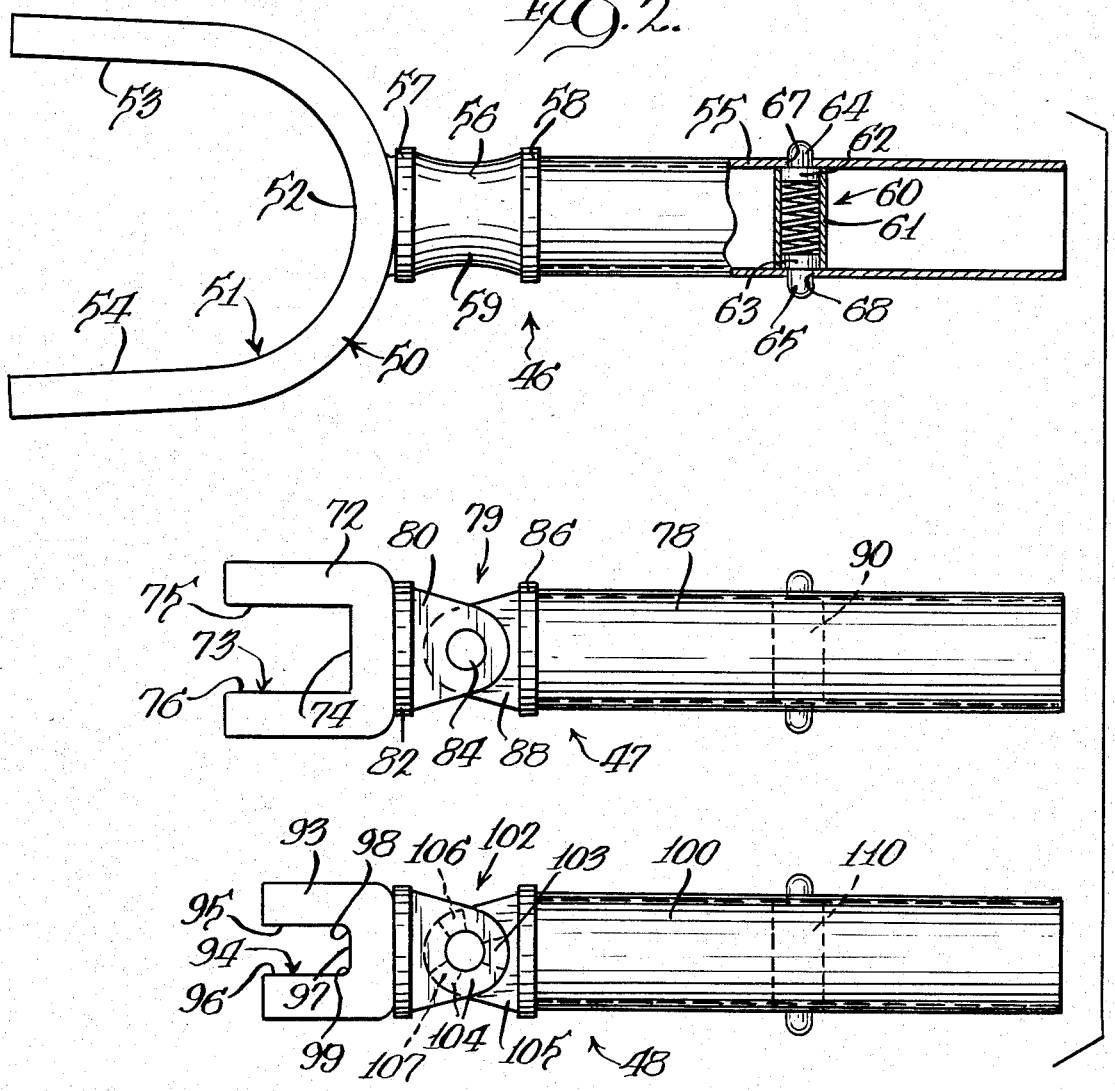
FIG. 2 is a plan view of the present kit of three reaction brace assemblies each interchangeable with the standard wall foot illustrated in FIG. 1.

According to the present invention and as illustrated in FIG. 2, a kit of brace assembly attachments is provided including brace assemblies 46, 47 and 48, each of which is adapted to be substituted for the wall reaction foot assembly 32 illustrated in FIG. 1 to permit the carpet stretcher 10 to react against vertical supports other than flat walls commonly found in buildings and thereby dramatically reduce the number of rod sections 24 required. They also eliminate the installer's assembly time for adding these additional rod sections. Above and apart from these advantages, however, the kit illustrated in FIG. 2 provides a much more rigid reaction support for the head 13 because the lesser number of telescopic tube sections reduces bending and swaying.

As seen in FIG. 2, the brace assembly 46 includes a large U-shaped retainer 50 with a generally U-shaped interior holding surface 51 having a central arcuate portion 52 and slightly outwardly diverging flat surfaces 53 and 54. The retainer 50 is fixed to a base tube 55 by a rigid coupler 56 having flanges 57 and 58 and a necked-down central portion 59. Tube 55 is sized with the same outer diameter as tube 35 in FIG. 1 so that it is insertable in the distal end of main rod section 24 in a similar fashion. Base tube 55 has a spring detent assembly 60 disposed approximately centrally thereof that includes a cross tube 61 that slidably supports enlarged heads 62 and 63 of detents 64 and 65 that project through diametral holes 67 and 68 in the base tube 55. Brace assembly 46 is attached to main tube 24, or any of the other telescopic tubes carried thereby, by inserting the end of the base tube 55 therein and manually withdrawing the detents 64 and 65 to permit them to pass within the base tube, and positioning the base tube so that the detents 64 and 65 snap into the desired one of the hole pairs 42 in the tube 24.

Figure 3:
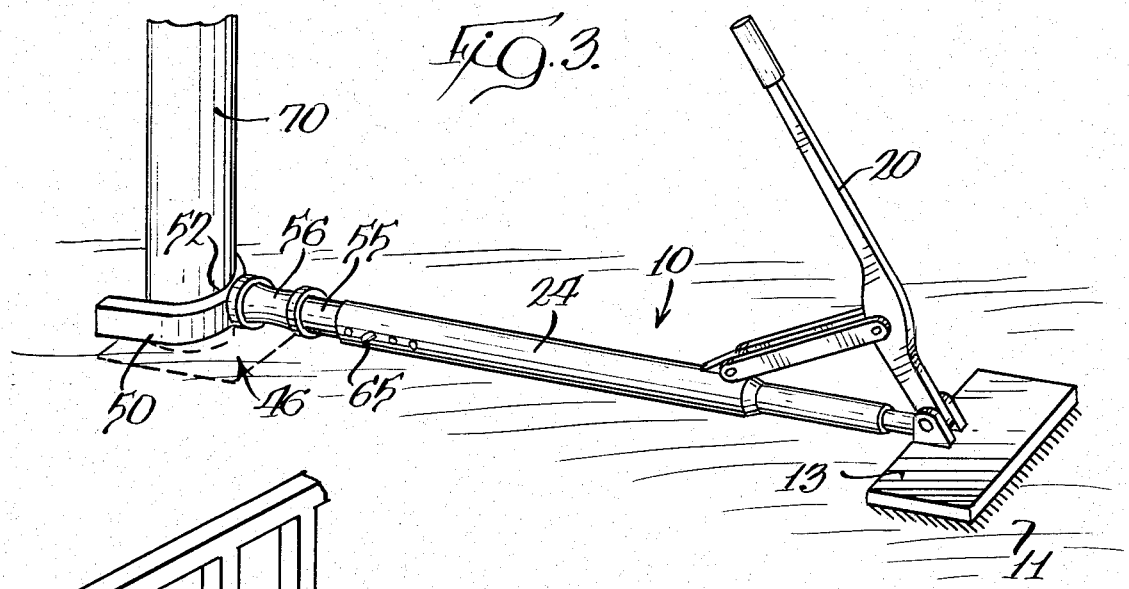
FIG. 3 is a perspective view of the carpet stretcher illustrated in FIG. 1, with one of the fit brace assemblies of FIG. 2 interchanged with the wall foot.

As seen in FIG. 3, the large brace 46 after insertion into the main tube 24, may be positioned so that the retainer 50 fits around a circular support column 70 frequently found in the carpet installation area at a central point more accessible than one of the outer walls. The rigid coupling 56 prevents any pivotal movement between the main tube 24 and the retainer 50. The arcuate configuration of interior surface 52 engaging the arcuate surface of support post 70, assures that the reaction force between head 13 through tube passes substantially centrally through support 70 minimizing any tendency for buckling of tube 24. The arcuate shape of interior surface 52 also permits the carpet stretcher 10 to be swung in any radial direction around support 70 increasing the range of stretching area for the stretcher 10.

As seen in FIG. 2, the present brace assembly kit includes an intermediate size brace assembly 47 that is particulaly designed to fit around vertical rectangular supports such as railings also commonly found in the carpet installation area. Toward this end the base assembly 47 includes a generally U-shaped retainer 72 having generally rectangular interior gripping surface 73, including a flat base surface 74 and flat parallel side surfaces 75 and 76 both perpendicular to base surface 74. The retainer 72 is connected to a base tube 78 by a vertical pivot assembly 79 including spaced bosses 80 and 81 fixed to flange 82, welded to retainer 72 that carry a pivot pin 84. Another flange 86, fixed to base tube 78, carries a boss 88 extending between the bosses 81 and 82 (see FIG. 4) and pivotally mounted on pivot pin 84 to complete pivotal interconnection 79. Base tube 78 carries a detent assembly 90 identical in configuration to detent assembly 60 illustrated in FIG. 2. Base tube 78 has the same diameter as base tube 55 so that it is interchangeable therewith within the distal end of tube section 24, illustrated in FIG. 1.

Figure 4:
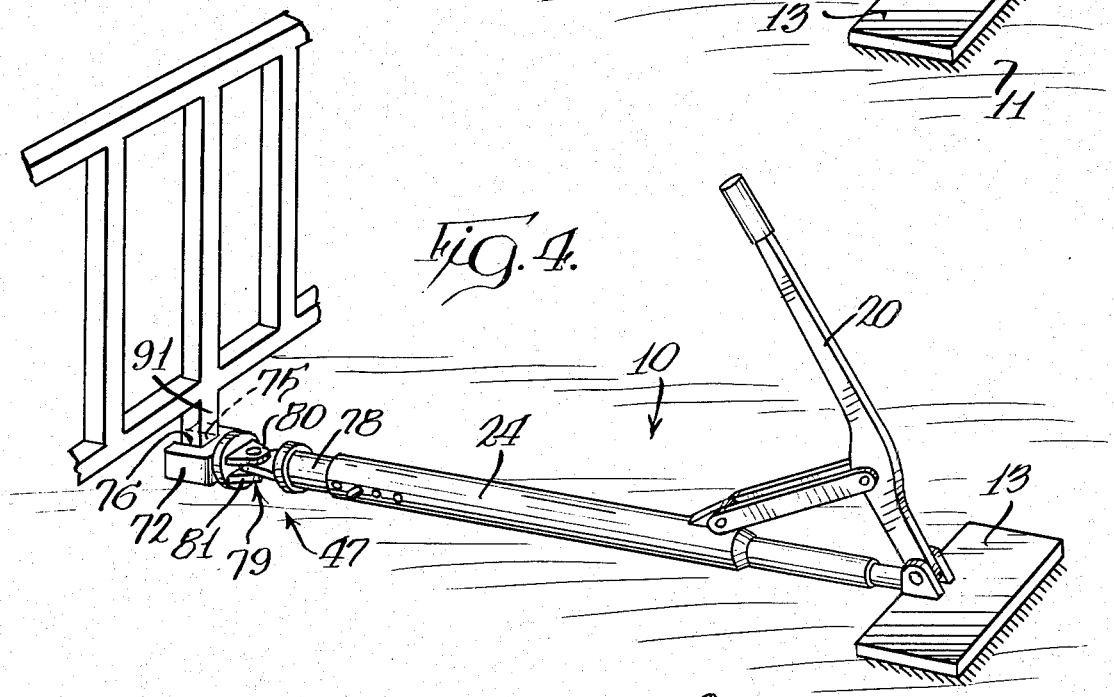
FIG. 4 is a perspective view of the carpet stretcher illustrated in FIG. 1, with the middle sized reaction brace assembly of FIG. 2 carried thereby.

As seen in FIG. 4, the retainer assembly 47, when connected to base tube 24, provides a reaction support in the stretcher against a rectangular vertical support member such as rectangular support 91 commonly found in railings in carpet installation areas. Retainer 47 is used by the installer in cases where support 92 is found to be sized large enough such that the interior surfaces 74, 75 and 76 prevent rotation of the retainer 72 with respect thereto. The lateral swing movement of the stretcher head 13 when the brace assembly 47 is used, is effected by the pivot assembly 79.

As seen in FIG. 2, the brace kit includes a small brace assembly 48 adapted to fit around either a small rectangular vertical support or a small cylindrical vertical support in the carpet installation area. Toward this end retainer assembly 48 has a U-shaped retainer 93 having an interior surface 94 including closely spaced parallel side surfaces 95 and 96 and an end surface 97 having arcuate end portions 98 and 99 joining with the parallel side surfaces 95 and 96, respectively. The retainer 93 is connected to a base tube 100 by a vertical pivotal interconnection 102 generally similar to the pivotal interconnection 79 illustrated in brace assembly 47. Pivotal connection 102 is somewhat different however in the provision of lugs 103 carried by bosses 104 that engage lugs 106 and 107 on boss 105 upon approximately thirty degrees of pivotal movement of tube 100 in either direction from a central position with respect to the retainer 93. Tube 100 carries a detent assembly 100 identical to detent assemblies 60 and 90 in the brace assemblies 46 and 47, respectively.

Figure 5:
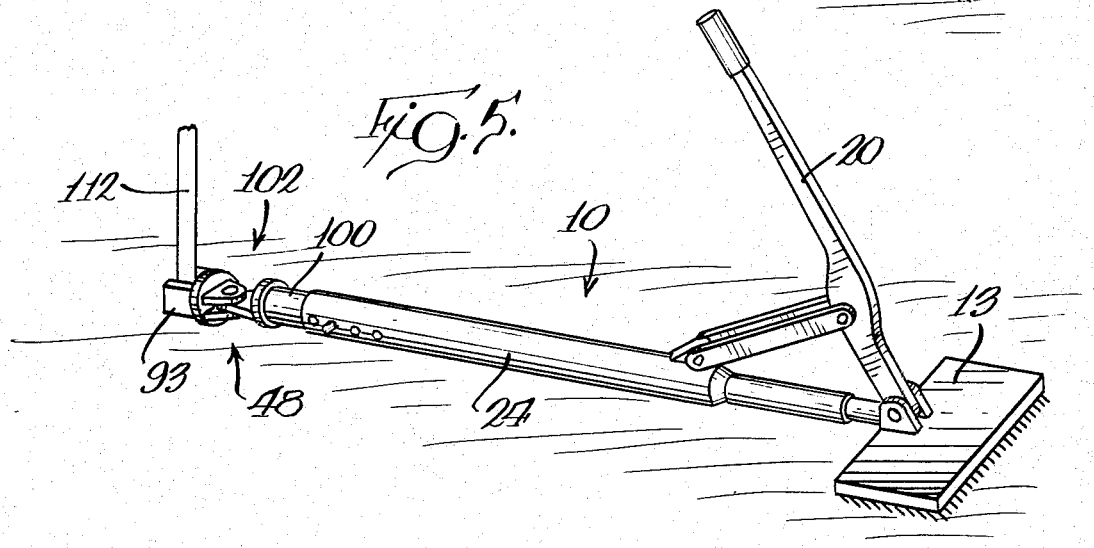
FIG. 5 is a perspective view of the carpet stretcher illustrated in FIG. 1 with the small brace assembly illustrated in FIG. 2 carried thereby.

As seen in FIG. 5, the brace assembly 48, when inserted into main tube 24, provides a reacting and holding function for the carpet stretcher 10 around a small vertical fixed support 112 such as pipes sometimes found in carpet installation areas. Since pipe 112 is round in outer configuration, the retainer 93 is free to pivot with respect to the pipe, but the cooperating lugs 103, 106, 107 limit pivotal movement of the retainer 93 about rod 112 to less than thirty degrees so that the reaction lines of force from carpet stretcher head 13 acting through tube 24 do not pass an excessive distance laterally away from the center of pipe 12. As noted above, the brace 48 can also be used around small rectangular rods and if they have sufficient diameter so that the side surfaces 96, 97 and 95 prevent rotation of retainer 93 with respect to the rectangular support member, the lugs 103, 106 and 107 do not come into play and the lateral movement of the head 13 and rod 24 is effected by the normal pivotal movement accommodated by vertical pivotal interconnection 102.

I claim:

1. A plurality of attachments for a carpet stretcher of the type having a carpet engaging head and a plurality of extensible tube sections connected to the head with the end tube section opposite the head being adapted to releasably receive a reaction foot having a flat surface adapted to react against a wall or the like, comprising; a first brace assembly for providing the entire reaction support for the head having a rod portion adapted to be releasably received within the end section of the carpet stretcher, a generally U-shaped retainer portion non-pivotally connected to said rod portion, said U-shaped retainer portion being constructed to fit around and pivot with respect to a vertical fixed support to provide the desired reaction force for the carpet stretcher head, said rod portion having locating means cooperating with the end section to angularly locate the U-shaped retainer portion in a horizontal plane, a second brace assembly for providing the entire reaction support for the head having a rod portion adapted to be releasably received within the end section of the carpet stretcher, a second generally U-shaped retainer portion pivotally connected to the second rod portion and being constructed to fit around and non-rotatably grip a non-circular fixed support, said second U-shaped retainer portion being smaller than the first U-shaped retainer portion to accommodate differently sized and shaped fixed supports, said second brace assembly rod portion having locating means cooperating with the end section to angularly locate the second U-shaped retainer portion in a horizontal plane, and means for limiting pivotal movement of the second U-shaped retainer portion with respect to the second brace assembly rod portion to less than about 30 degrees to provide reaction force to the stretcher head.

2. A plurality of attachments for a carpet stretcher of the type having a carpet engaging head and a plurality of extensible tube sections connected to the head with the end tube section opposite the head being adapted to releasably receive a reaction foot having a flat surface adapted to react against a wall or the like, as defined in claim 1, wherein the first U-shaped retainer portion has an arcuate interior surface adapted to fit around an arcuate fixed support and pivot with respect thereto.

3. A plurality of attachments for a carpet stretcher of the type having a carpet engaging head and a plurality of extensible tube sections connected to the head with the end tube section opposite the head being adapted to releasably receive a reaction foot having a flat surface adapted to react against a wall or the like, as defined in claim 1, wherein the second U-shaped retainer portion has three substantially flat interior surfaces adapted to fit around and grip a rectangular fixed support without any significant pivotal movement with respect thereto.

4. A plurality of attachments for a carpet stretcher of the type having a carpet engaging head and a plurality of extensible tube sections connected to the head with the tube section opposite the head being adapted to releasably receive a reaction foot having a flat surface adapted to react against a wall or the like, comprising; a first brace assembly including a rod portion adapted to be releasably connected to the end section of the carpet stretcher, a generally U-shaped retainer portion carried by the rod portion and adapted to fit around a fixed support in the area of the carpet being installed, said rod portion having locating means cooperating with the opposite tube section to angularly position the U-shaped retainer portion in a horizontal plane, means for limiting angular movement between the U-shaped retainer portion and the rod portion, a second brace assembly including a rod portion adapted to be releasably connected to the end section of the carpet stretcher, a generally U-shaped retainer portion pivotally connected to the second brace assembly rod portion and adapted to fit around a fixed support in the area of the carpet being installed, said second brace assembly retainer portion being substantially smaller than the retainer portion in the first brace assembly, said second brace assembly rod portion having locating means cooperating with the opposite tube section to angularly position the second brace assembly U-shaped portion in a horizontal plane, and means for limiting angular movement between the second brace assembly U-shaped retainer and the second brace assembly rod portion to less than about 30 degrees to provide reaction force to the stretcher head.

5. A plurality of attachments for a carpet stretcher of the type having a carpet engaging head and a plurality of extensible tube sections connected to the head with the end tube section opposite the head being adapted to releasably receive a reaction foot having a flat surface adapted to react against a wall or the like, as defined in claim 4, wherein said U-shaped retainer portion in said first brace assembly is non-pivotally connected to its rod portion, and said U-shaped retainer portion in said second brace assembly is pivotally connected to its rod portion about a vertical axis.

6. An attachment for a carpet stretcher of the type having a carpet engaging head and a plurality of extensible tube sections connected to the head with the end tube section opposite the head being adapted to releasably receive a reaction foot having a flat surface adapted to react against a wall or the like, comprising; a brace assembly including a rod portion adapted to be releasably connected to the end section of the carpet stretcher, a generally U-shaped retainer portion pivotally carried by the rod portion about a vertical axis and adapted to fit around a fixed support in the area of the carpet being installed, said rod portion having locating means cooperating with the opposite tube section to angularly locate the U-shaped retainer portion in a horizontal plane, and means for limiting angular movement between the rod portion and the U-shaped retainer portion to about 30 degrees to provide the necessary reaction force for the stretcher head.

* * * * *